United States Patent [19]

Klein et al.

[11] Patent Number: 4,758,179

[45] Date of Patent: Jul. 19, 1988

[54] SEPARABLE SHIELDED CONNECTOR FOR SHIELDED RIBBON CABLING

[75] Inventors: Laurence R. Klein, Torrance; Jackson R. Iblings, Encino, both of Calif.

[73] Assignee: The Zippertubing Company, Los Angeles, Calif.

[21] Appl. No.: 42,380

[22] Filed: Apr. 24, 1987

[51] Int. Cl.[4] ..... H01R 9/07; H01R 13/658

[52] U.S. Cl. ..... 439/497; 439/609; 439/610

[58] Field of Search ..... 439/494–499, 439/460, 465, 469, 609, 610

[56] References Cited

U.S. PATENT DOCUMENTS 4,272,148 6/1981 Knack ..... 439/610 X
4,534,608 8/1985 Scott et al. ..... 439/345
4,536,045 8/1985 Reichardt et al. ..... 439/497 X
4,597,624 7/1986 Lax et al. ..... 439/610
4,619,487 10/1986 Brush ..... 439/497 X

*Primary Examiner*—Eugene F. Desmond
*Attorney, Agent, or Firm*—Christie, Parker & Hale

[57] ABSTRACT

Disclosed is a separable connector for ribbon cabling enclosed in a shielded jacket. A grounding shoe is insertable into the jacket end and clampable in captive contact with the shield, the jacket and the cabling by a pair of cable strain relief clamping member subassemblies, the cabling conductors being connectible to a respective contactor of a shielded multiple contactor subassembly. These two subassemblies are seatable captively in spaced apart chambers provided adjacent the opposite ends of metallic housing halves with an exposed portion of the grounding shoe in contact with at least one of the housing halves.

13 Claims, 2 Drawing Sheets

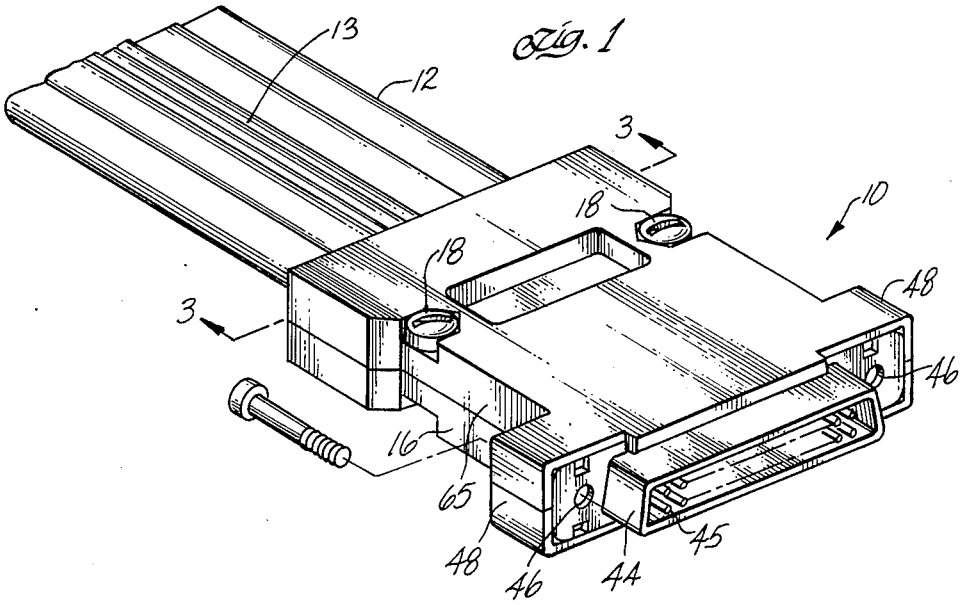
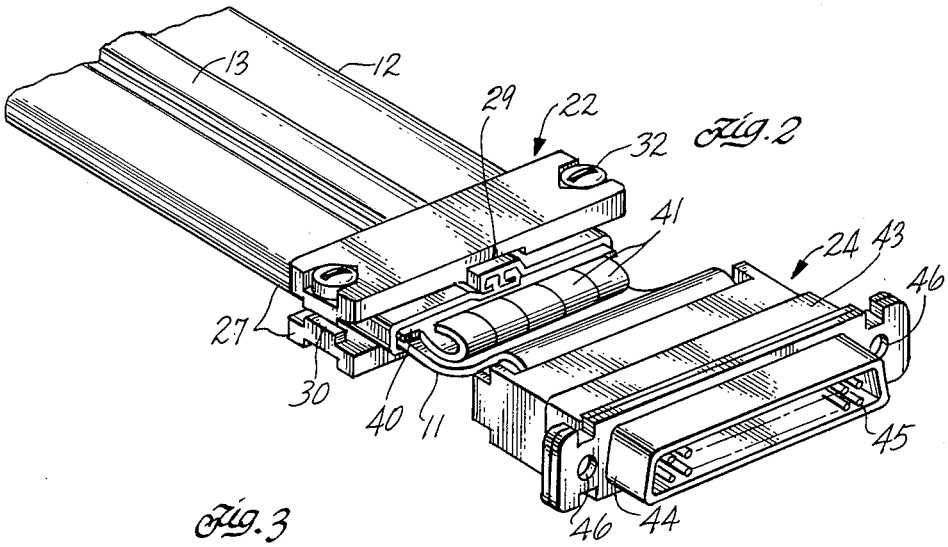
Fig. 3
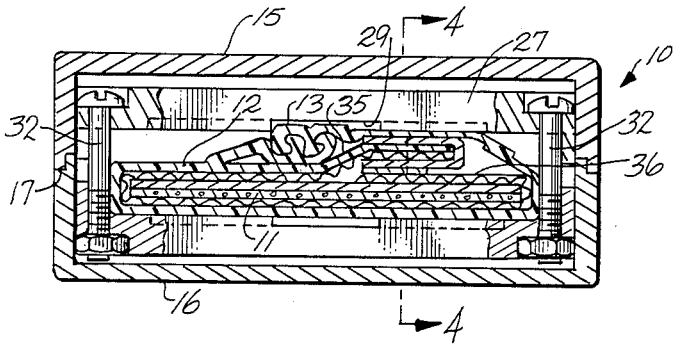

Fig. 4
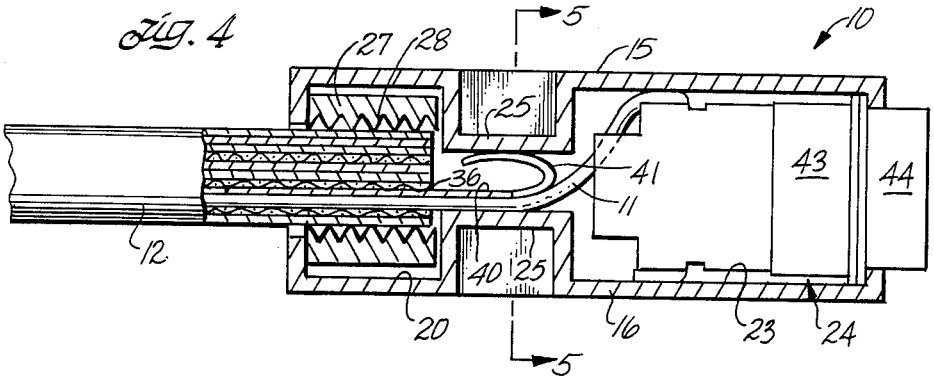
Fig. 5
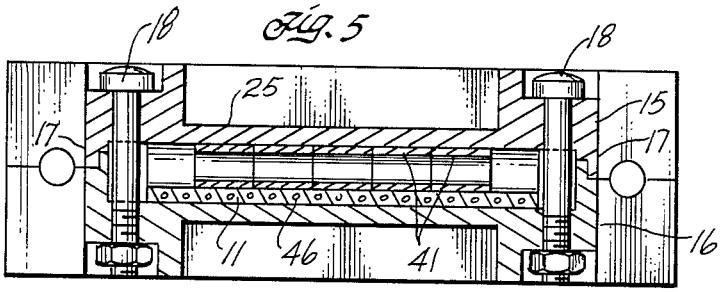
Fig. 6
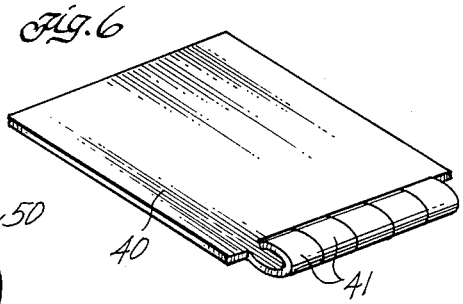
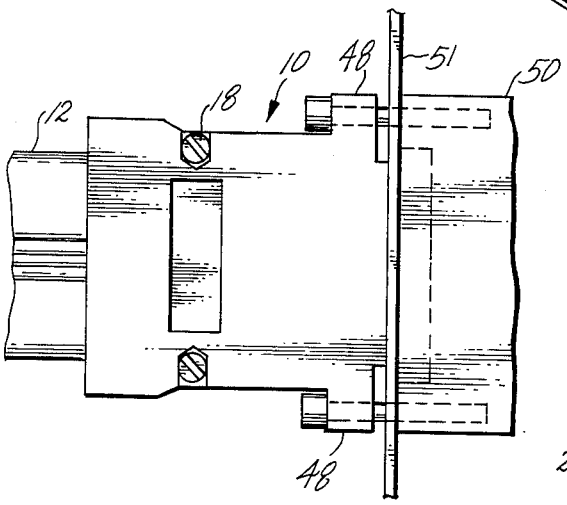
Fig. 8
Fig. 7
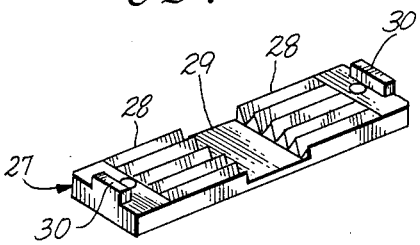

SEPARABLE SHIELDED CONNECTOR FOR SHIELDED RIBBON CABLING

This invention relates to separable cable connectors and more particularly to a unique simplified assembly having metallic housing halves providing cable strain relief and a continuous shield between the cable shield and the similarly shielded over half of the connector.

BACKGROUND OF THE INVENTION

Ribbon cabling is now in widespread use and many proposals have been made for equipping terminals of such cabling with separable connectors. If the cabling is housed in shielded jacketing, it is desirable that the separable connector have effective shielding provisions for the portion of the cabling embraced thereby. Various U. S. patents disclose cable coupling connectors having different expedients intended to provide such shielding capabilities, including Kelly U.S. Pat. No. 3,448,430; Shaeffer U.S. Pat. No. 4,025,145; Scott U.S. Pat. No. 4,534,608; Marcos U.S. Pat. Nos. 4,536,053 and 4,540,224; and Worth U.S. Pat. No. 4,537,458. Kelly, Schaeffer and Marcos U.S. Pat. No. 4,540,224, propose different conductive shoe devices insertable into cable jacketing to provide a grounding contact between the jacket shield and some part of a metallic connector housing. In general and by typical prior art the connectors are structurally complex and time consuming to assemble. Some require cutting away or tailoring the protective sheath or jacket for the cable shielding. None have provision for utilizing jacketing equipped with a separable seam providing access to the cabling.

SUMMARY OF THE INVENTION

The separable shielded connector for ribbon cabling provided by this invention is characterized by its simplicity, minimal number of components, ease of making electrical contact with the cable shield without need for performing any tailoring operation on the jacket or its shield, provision for use with seamed jacketing, and the provision of a strain relief for single or multiple ribbon cables and its jacketing. The metallic housing for the connector comprises duplicate halves provided with overlapping lateral edges and separate chambers for a combined cable strain relief and anchorage for a grounding shoe and for a cable contactor pin unit.

Accordingly it is a primary object of this invention to provide a new and improved simplified shielded connector for shielded ribbon cabling including cabling enclosed in separable seamed jacketing.

Another object of the invention is the provision of an improved separable connector having a metallic housing of identical halves provided with overlapping lateral edges.

Another object of the invention is the provision of a separable shielded connector for ribbon cabling having a housing formed of duplicate halves provided with separate chambers at its respective ends for a cable and jacket strain relief subassembly and with a shielded multiple contactor subassembly.

Another object of the invention is the provision of a simplified separable shielded connector utilizing a grounding shoe insertable between the cable shield and its jacket and having an exposed end in wiping contact with the interior of the connector housing.

These and other more specific objects will appear upon reading the following specification and claims and upon considering in connection therewith the attached drawing to which they relate.

Referring now to the drawing in which a preferred embodiment of the invention is illustrated:

FIG. 1 is a perspective view of the male half of the invention connector for ribbon cabling;

FIG. 2 is a view similar to FIG. 1 but with the two halves of the connector housing detached;

FIG. 3 is a cross sectional view on a slightly enlarged scale taken along line 3—3 on FIG. 1;

FIG. 4 is a cross sectional view taken along line 4—4 on FIG. 3;

FIG. 5 is a cross sectional view taken along line 5—5 on FIG. 4;

FIG. 6 is a perspective view of the grounding shoe providing electrical continuity between the cable shielding and the metallic connector housing;

FIG. 7 is a perspective view of one of the strain relief members serving to anchor the grounding shoe to the cable shielding and cooperating with the housing to provide cable strain relief; and FIG. 8 is a plan view of the FIG. 1 connector assembly operatively associated with a mating companion connector mounted on the inner side of a shielded enclosure.

Referring to FIGS. 1 to 3, there is shown the male half of a shielded ribbon cable connector, designated generally 10, embodying the principles of this invention. The connector is shown assembled to one end of ribbon cabling 11 (FIG. 3) enclosed in shielded jacketing 12 provided with a separable plastic seam 13 extending lengthwise thereof.

As is best shown in FIG. 4, the connector housing is formed in two identical halves 15, 16 which comprise identical metallic generally cup-shaped halves having overlapping perimeter edges which inter fit snugly shiplap fashion as is best shown at 17 in FIG. 5. These overlapping edges safeguard against passage of electromagnetic waves and the like energy. The housing halves are held rigidly assembled by suitable fastener means such as the bolts 18, 18.

As best appears from FIG. 4, the interior of the housing halves are formed with a rear recess 20 (FIG. 4) loosely but captively seating a strain release sub-assembly, designated generally 22, and a forward recess 23 at the forward end thereof embracing a shielded contactor sub-assembly 24. The latter sub-assembly has terminals to which a respective one of the cable conductors is attached in a manner well known to persons skilled in this art. The two chambers 20 and 23 are spaced apart by a pair of upstanding walls 25 having their inner surfaces lying generally parallel to one another and spaced apart to serve an important function of the invention to be described presently. As clearly appears from FIG. 4, the opposite ends of the housing halves are provided with appropriately shaped and sized openings, the one accommodating the cabling assembly 12 and the other accommodating the foremost end of the cable contactor sub-assembly 24.

Sub-assembly 22 performs multiple functions including providing a firm anchorage between the cabling and the connector housing halves 15, 16 and providing a simple highly effective and efficient means for clamping the cabling shield to a grounding shoe shown in FIG. 6 and to be desribed in greater detail presently. Sub-assembly 22 comprises a pair of identical elongated metallic clamping members that are formed along their adjacent sides with sharp edge projections 28. A shallow passage 29 transversely of their mid-length (FIG. 7) accommodates the jacket seam 13 as best appears in FIG. 3. The opposite ends of clamping members 27 are provided with low height bosses 30, 30 suitably dimensioned to limit and prevent excessive tightening of the clamping members of suitable fasteners such as bolt 32. Sub-assembly 22 has a loose fit in chamber 20 and has slight limited movement within this chamber.

Typically, jacketing 12 is of a well known type having an exterior flexible plastic main body slit lengthwise thereof and equipped along the opposite lateral edges of the slit with extruded separable plastic seam means 13 well known to persons skilled in this art. One seam member is secured at a substantial distance inwardly from one lateral edge of the slit to provide a guard flap (FIG. 3) fully bridging the seam when the latter is closed. Secured to one lateral edge of this guard flap is a layer of conductive shielding material 36 which is sufficiently wide to fully embrace the ribbon cabling 11 and overlaps with the other edge of the shielding when the seam is closed.

This invention provides simple expeditious means for providing and assuring continuity of conductivity between this shielding layer 36 and the connector housing 15, 16 without need for performing any tailoring operations on the cable jacket or is shield other than severing the forward end of the jacket and its shield in a common plane with an adequate length of the ribbon cable conductors extending therebeyond for connection to the separate contactors of sub-assembly 24. This means comprises an elongated resilient grounding shoe 40 of beryllium copper or the like. The forward end of this shoe is formed with spaced-apart slits providing a plurality of overturned tongues 41. These highly resilient tongues are in pressurized contact with one of the housing walls 25, 25 when the connector housing is assembled.

The conductor contactor assembly 24 is of any suitable conventional design embraced at its forward end with abutting metallic shrouds 43, 44, the outer one of which embraces the male contactor pins 45 for each of the cable conductors. Lateral extensions integral with the abutting ends of members 43, 44 are formed with holes 46 registerable with similar holes in ears 48 (FIGS. 1 and 8) integral with the forward end of the connector housing. Holes 46 accommodate fasteners for securing sub-assembly 24 to the connector housing 15, 16 or to a mating female connector half 50 (FIG. 8) which may be held clamped by these fasteners to the shielding wall 51 of equipment utilizing the invention connector.

The exceedingly simple mode of assembling the small number of components of the invention shielded connector will be readily apparent from the foregoing description of the components and their relationship to one another. The operator simply severs the forward end of jacket 12 and its unitary shield 11 sufficiently rearwardly of the end of the cable conductors 11 to permit their attachment to the contactor sub-assembly 24. The next step is to insert the rear end of contactor shoe 40 into the forward end of the jacket in an area in direct contact with shielding layer 36 as, for example, between the cable conductors and the adjacent face of shield 36. The strain relief clamping members 27, 27 are then assembled astride the forward end of the jacket and fasteners 32 are tightened causing the sharp edged projections 28 of these members to bite into and form a strong anchorage with the jacket as well as clamping the grounding shoe 40 in wide area firm contact with shield layer 36. The backwardly curled ends of 41 of the shoe are then exposed and positioned for firm electrical contact with one of the contactor housing walls 25 when assembled therebetween.

The assembly is completed by connecting the cable conductors to respective contacts of sub-assembly 24 and inserting this sub-assembly in one of the connector housing chambers 23 and thereafter enclosing it along with the strain relief sub-assembly 22 using the other housing half and fasteners 18 to secure the components together.

While the particular separable shielded connector for shielded ribbon cabling herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A separable cable connector unit for use with at least one shielded ribbon cable embraced by an insulated jacket and a conductive shielding layer comprising:

a pair of elongated metal housing halves adapted to embrace and enclose the terminal end of said ribbon cabling and having recesses facing toward one another between and opening through a respective one of the opposite ends thereof and cooperating to provide forward and rearward chambers when held clamped together;

said forward chamber being adapted to embrace and retain captive therein multiple conductor contactor means for said ribbon cabling;

said rearward chamber including a pair of members adapted to bridge the opposite sides of said ribbon cabling and including means for clamping the same immovably therebetween and retain the same captive in said rearward chamber;

an elongated metallic grounding shoe having one end adapted to be inserted in the terminal end of said jacket in contact with said shielding layer and having another portion thereof positioned for pressurized contact with a metallic area of said housing halves when the latter are clamped in assembled position; and means for securing said housing halves separably together.

2. A separable connector unit as defined in claim 1 characterized in that the adjacent opposite lateral edges of said housing halves overlap ship-lap fashion to provide a continuous metal shield between the opposite ends of said connector unit.

3. A separable connector unit as defined in claim 1 characterized in that said pair of cable clamping members have means projecting toward one another from the facing sides thereof shaped and sized to partially penetrate into the outer side of shielded jacketing when assembled about said ribbon cabling and anchor the same immovably in place between said clamping members when clamped together thereby to provide a strain relief for said cabling.

4. A separable connector unit as defined in claim 1 characterized in that the facing sides of said pair of cable clamping members are notched transversely thereof to accommodate the separable seam of an insulated shielded jacket for said ribbon cabling having a separable seam extending lengthwise thereof.

5. A separable connector unit as defined in claim 1 characterized in that said housing halves are substantially identical and formed of cast metal.

6. A separable connector unit as defined in claim 1 characterized in that the opposite lateral edges of the forward end of the housing halves include perforated outward projections; a multiple contactor means sized to be seated in said forward chamber and including tubular conductive shroud means and including perforated ears for registry with said perforated projections on said housing halves for the reception of fastener means to clamp said shroud means to said housing halves.

7. A connector unit as defined in claim 1 characterized in that said grounding shoe has an exposed end projecting outwardly from said jacket and positioned to lie in pressure contact with one of said housing halves when in assembled condition.

8. A connector unit as defined in claim 1 characterized in that said pair of clamping members bridging and clamping said ribbon cabling assembled therebetween is in an area embracing the adjacent end of said jacket whereby said clamping members are effective to clamp said ribbon cabling, said grounding shoe and said jacket immovably together.

9. A connector unit as defined in claim 9 characterized in that said housing halves between said forward and rearward chambers include an upstanding wall positioned to be in pressure contact with the exposed end of said grounding shoe when said housing halves are held assembled thereabout.

10. A separable cable connector unit adapted to be assembled to one terminal end of at least one ribbon cable enclosed in an insulation sheath lined interiorly with conducting shielding material, said separable connector unit comprising:

an elongated metallic grounding shoe, one end of which is insertable into the end of said sheath in contact with conductive shielding lining, and with the other end exposed beyond the end of said sheath;

a pair of elongated sheath clamping members for assembly transversely of the exterior of said sheath and said grounding shoe and including means for clamping the same immovably against said sheath and the underlying contents thereof;

multiple conductor contactor means having separate contactors connectible to a respective one of the conductors of said ribbon cabling aligned with the clamping members;

a pair of substantially identical metallic housing halves adapted to be clamped together astride said pair of elongated clamping members and astride said multiple contactor means for maintaining the end of the cable and the contactor means in alignment at opposite ends of the connector, and with a portion of at least one of said housing halves in firm contact with the exposed end of said shoe; and a plurality of resilient fingers on said grounding shoe for wiping contact with an interior surface of one of said housing halves between the sheath clamping members and the contactor means when the connector is assembled.

11. A separable cable connector unit adapted to be assembled to one terminal end of at least one ribbon cable enclosed in an insulation sheath lined interiorly with conducting shielding material, said separable connector unit comprising:

an elongated metallic shoe one end of which is insertable into the end of said sheath in contact with conductive shielding lining with the other end exposed beyond the end of said sheath;

a pair of elongated sheath clamping members for assembly transversely of the exterior of said sheath and said grounding shoe and including means for clamping the same immovably against said sheath and the underlying contents thereof;

multiple conductor contactor means having separate contactors connectible to a respective one of the conductors of said ribbon cabling; and a pair of metallic housing halves adapted to be clamped together astride said pair of elongated clamping members and astride a said multiple contactor means with a portion of at least one of said housing halves in firm contact with the exposed end of said shoe; and wherein said sheath clamping members and said conductor contactor means are seatable in spaced apart chambers interiorly of and between the opposite ends of said housing halves; and said housing halves have an interior surface positioned to be contacted by said exposed end of said grounding shoe as said housing halves are clamped in assembled position.

12. A connector as defined in claim 11 characterized in that the opposite lateral edges of said housing halves include portions overlapping with one another when assembled to one another.

13. A connector as defined in claim 11 characterized in that said housing halves are identical.

* * * * *

UNITED STATES PATENT AND TRADEMARK OFFICE

CERTIFICATE OF CORRECTION

PATENT NO. : 4,758,179

DATED : July 19, 1988

INVENTOR(S) : Laurence R. Klein and Jackson R. Iblings

It is certified that error appears in the above-identified patent and that said Letters Patent is hereby corrected as shown below:

In the Specification

Column 1, line 9, change "over" to -- other --.
Column 3, line 6, after "members" delete "of" and insert therefor -- by --.
Column 3, line 6, change "bolt" to -- bolts --.
Column 3, line 26, delete "is" and insert therefor -- its --.

In the Claims

Column 5, line 30, in claim 9 after "defined in" delete "claim 9" and insert therefor -- claim 8 --.

Signed and Sealed this

Twenty-seventh Day of December, 1988

*Attest:*

DONALD J. QUIGG

*Attesting Officer*

*Commissioner of Patents and Trademarks*